United States Patent [19]

Rosenberg

[11] Patent Number: 4,600,340

[45] Date of Patent: Jul. 15, 1986

[54] MINE ROOF SUPPORT UNIT

[75] Inventor: Harry Rosenberg, Lüdinghausen, Fed. Rep. of Germany

[73] Assignee: Gewerkschaft Eisenhutte Westfalia, Lunen, Fed. Rep. of Germany

[21] Appl. No.: 687,821

[22] Filed: Dec. 31, 1984

[30] Foreign Application Priority Data

Jan. 12, 1984 [DE] Fed. Rep. of Germany ..... 3400771

[51] Int. Cl.[4] ..... E21D 15/52; E21D 23/00

[52] U.S. Cl. ..... 405/297; 405/299

[58] Field of Search ..... 405/291, 292, 295, 296, 405/297, 299, 302; 299/31-33; 248/357

[56] References Cited

U.S. PATENT DOCUMENTS

| | | | |
|---|---|---|---|
| 3,218,812 | 11/1965 | Wilkenloh | 405/297 |
| 3,640,581 | 2/1972 | Rassman et al. | 299/32 |
| 3,748,861 | 7/1973 | Groetschel | 405/297 |
| 3,811,288 | 5/1974 | Wehner et al. | 405/297 X |
| 3,915,500 | 10/1975 | Schlusener et al. | 405/296 |
| 3,990,251 | 11/1976 | Wehner et al. | 405/291 |
| 4,102,139 | 7/1978 | Wake | 405/299 |
| 4,139,325 | 2/1979 | Bower et al. | 405/291 |
| 4,217,067 | 8/1980 | Lagodka et al. | 405/296 |
| 4,311,417 | 1/1982 | Bower et al. | 405/297 |
| 4,379,661 | 4/1983 | Wojaczek et al. | 405/291 X |

FOREIGN PATENT DOCUMENTS

| | | | |
|---|---|---|---|
| 1290507 | 3/1969 | Fed. Rep. of Germany | 299/32 |

*Primary Examiner*—Cornelius J. Husar
*Assistant Examiner*—Nancy J. Stodola
*Attorney, Agent, or Firm*—Thompson, Birch, Gauthier & Samuels

[57] ABSTRACT

A mine roof support unit includes a pair of generally parallel floor girders, and an advance mechanism positioned between the floor girders. The advance mechanism comprises a hydraulic advance ram and a guide rod system. The advance ram is pivotally connected between the guide rod system and a cross member which interconnects the floor girders. The guide rod system is attachable to a longwall conveyor positioned adjacent to a work face. The cross member is engageable with the floor girders in such a manner that the floor girders are relatively displaceable in a vertical direction. Each of the floor girders is provided with a respective hydraulic lifting ram, the arrangement being such that the lifting rams can be operated to lift one of the floor girders relative to the other floor girder.

18 Claims, 8 Drawing Figures

MINE ROOF SUPPORT UNIT

BACKGROUND TO THE INVENTION

This invention relates to a mine roof support unit of the type having hydraulic props supported on two generally parallel floor girders.

Typically, a roof support unit of this type has an advance mechanism arranged between the floor girders. The advance mechanism has a hydraulic advance ram pivotally arranged between a guide rod system and a cross member. The guide rod system is connected to an abutment member such as a longwall conveyor, and the cross member interconnects the floor girders, while enabling them to be vertically displaced. To enable the floor girders to adapt to uneven areas of the floor independently of each other, the cross member may be mounted in vertical guide slots in the floor girders.

In practice, difficulties can arise during advance movements, particularly if the face-side ends of the floor girders encounter a step in the floor, or if their front ends have dug into the soft floor. Troublesome and tedious measures then have to be taken in order to lift the floor girders to a sufficient extent to enable the roof support unit to be advanced in the required manner.

Numerous proposals have been made for mechanically lifting the tips of the floor girders of such a roof support unit. For example, use can be made of a hydraulic lifting ram arranged in a housing on the cross member. The lifting ram is braced on the guide rod system by a slide member, and lifts the two floor girders by way of the cross member. (See DE-OS No. 3 301 262, DE-OS No. 3 211 455, DE-OS No. 3 002 796, U.S. Pat. No. 4,102,139 and Colliery Guardian February 1970, page 98).

The aim of the invention is to provide a mine roof support unit with hydraulic lifting means which are better suited to the conditions obtaining in underground mining operations.

SUMMARY OF THE INVENTION

The present invention provides a mine roof support unit including a pair of generally parallel floor girders, and an advance mechanism positioned between the floor girders, the advance mechanism comprising a hydraulic advance ram and a guide rod system, the advance ram being pivotally connected between the guide rod system and a cross member which interconnects the floor girders, the guide rod system being attachable to an abutment means positioned adjacent to a work face, the cross member being engageable with the floor girders in such a manner that the floor girders are relatively displaceable in a vertical direction, wherein each of the floor girders is provided with a respective lifting mechanism, the arrangement being such that the lifting mechanisms can be operated to lift one of the floor girders relative to the other floor girder.

Advantageously, each lifting mechanism includes a hydraulic lifting ram mounted on the associated floor girder.

Instead of a single relatively large lifting ram, this roof support unit uses two smaller lifting rams, and these can be so arranged that the two floor girders, which are movable relatively to each other in the vertical direction, can be raised not only jointly but also independently of each other, and also to different extents. Thus, the lifting mechanisms of this roof support unit can easily be adapted to operating conditions, and the two smaller lifting rams can be fitted relatively easily.

Preferably, the lifting rams are positioned on the goaf side of the cross member. Consequently, the free space in front of the props of the roof support unit is not blocked by the lifting mechanisms. It is recommended that the lifting rams are located close behind the cross member.

Advantageously, the piston rod of the advance ram is connected to the cross member, and the lifting rams are arranged one at each side of the piston rod of the advance ram. This arrangement enables the two lifting rams to be installed in the space between the two floor girders, and to be set back a relatively great distance from the tips of the floor girders, thereby affording protection to the lifting rams and effecting a saving in space, without the lifting rams being in the path of the working stroke of the advance ram.

In a preferred embodiment, the roof support unit further comprises a slide plate positioned between the two floor girders, the slide plate forming an abutment for the two lifting rams. In this way, the lifting rams can be braced against the guide rod system. Advantageously, the slide plate is rigidly connected to the guide rod system. It is, however, also possible to brace the lifting rams against the floor of the working, thereby bypassing the guide rod system. In this case, the slide plate is advantageously a floor plate which rests on the floor of the working, and is connected to the guide rod system.

The invention is directed in particular to a roof support unit wherein the guide rod system is constituted by two laterally-spaced, cylindrical, resilient guide rods which are connected together at their front (face-side) ends by a head-piece, and whose rear (goaf-side) ends are guided on the floor girders for movement in the advance direction. Preferably, the two guide rods have laterally outwardly off-set portions, said off-set portions having a length which is greater than the length of the working stroke of the advance ram, and wherein the slide plate is fixed to said off-set portions of the guide rods. Conveniently, the two guide rods are gripped between the slide plate and an underlying complementary plate, the two plates being provided with distance pieces which space them from each other, and the two plates being fixed together by screw-threaded members.

Advantageously, each of the floor girders is provided with an upstanding connection piece to which the associated lifting mechanism is mounted. Preferably, each of the connection pieces is a cheek plate, the cheek plates being provided with openings for receiving the cross member.

In a preferred embodiment, each of the lifting rams is housed in a holder, the holders being provided with mounting flanges for attachment, by means of bolts, to the connection pieces. Advantageously, each of the holders is provided with a stud which engages in an aperture formed in the associated connection piece. The studs, which are of high-strength, take up the lifting forces without subjecting the fixing bolts to shear load. Preferably, each of the holders is constituted by a rear plate and two side plates rigidly connected thereto, the rear plate defining said mounting flanges, and the two side plates defining a connection point for the piston rod of the associated lifting ram, the rear and side plates of each holder accommodating the associated lifting ram.

Conveniently, each holder further comprises a bottom sleeve which encloses the lower end of the associated lifting ram, and which is rigidly fixed to the respective rear plate. The holders together with the lifting rams form units which can be readily mounted on the connection pieces. The holders protect the lifting rams from damage and, in particular, from harmful transverse forces.

BRIEF DESCRIPTION OF THE DRAWINGS

A mine roof support unit constructed in accordance with the invention will now be described, by way of example, with reference to the accompanying drawings, in which.

DESCRIPTION OF PREFERRED EMBODIMENTS

Figure 1:
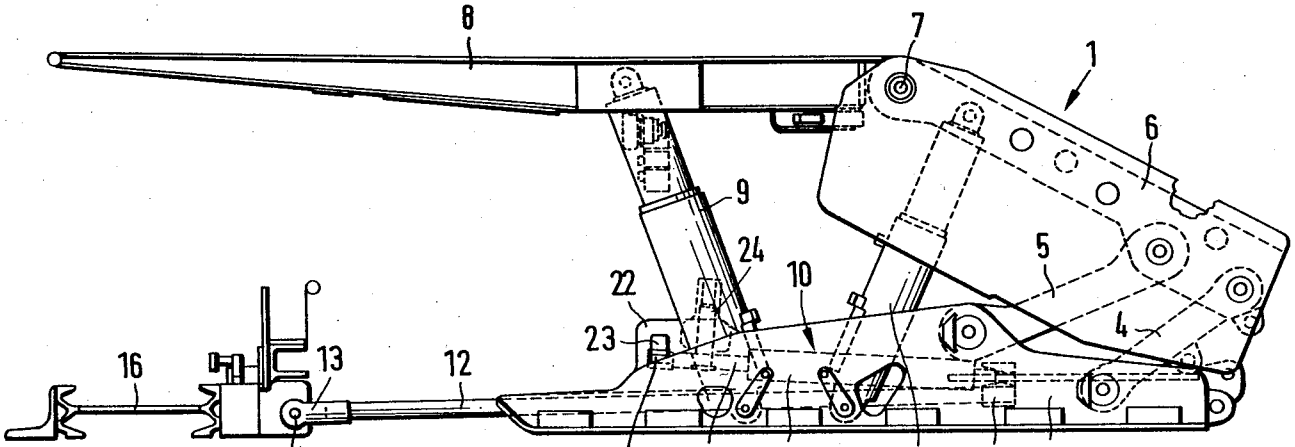
FIG. 1 is a side elevation of the roof support unit.

Referring to the drawings, FIG. 1 shows a roof support unit, indicated generally by the reference numeral 1, having a floor sill constituted by two laterally-spaced, parallel floor girders 2 and 3. The rear portions of the floor girders 2 and 3 are coupled, by means of lemniscate linkages 4 and 5, to a common goaf shield 6. The upper end of the goaf shield 6 is connected, by means of pivot joints 7, to the rear end of a roof cap 8. Hydraulic props 9 are pivotally mounted between the roof cap 8 and the two floor girders 2 and 3, two hydraulic props being supported on each of the floor girders in a V-shaped arrangement.

An advance mechanism 10 is located in the space between the two floor girders 2 and 3. The advance mechanism 10 is constituted by a double-acting hydraulic advance ram 11 and a guide rod system comprising two cylindrical, resilient, laterally-spaced guide rods 12. At their forward ends, the guide rods 12 are interconnected by a common rod head-piece 13; and, at their rear ends, they are interconnected by way of a yoke 14. The head-piece 13 is connected, by means of a pivot joint 15 having an axis extending parallel to the face, to a longwall scraper-chain conveyor 16 (or to any other suitable abutment means). The conveyor 16 may incorporate a guide for a winning machine (not shown). The two guide rods 12 are guided in the advance direction on the two floor girders 2 and 3. For this purpose, the yoke 14 is guided on guide rails 17, which are secured to the mututually-facing sides of the rear zones of the two floor girders 2 and 3.

The cylinder of the advance ram 11 is connected to the yoke 14 by means of a pivot joint 18. Its piston rod 19 is connected, by a pivot joint 20, to a cross member 21, which laterally spaces the two floor girders 2 and 3 in the forward zone, but permits the floor girders to move vertically relative to each other. At their mutually facing sides, the floor girders 2 and 3 have upstanding cheek plates 22, which have vertical slots 23 for engagement with the cross member 21.

When the advance ram 11 is retracted, the longwall conveyor 16 is advanced towards the face by means of the guide rod system 12; the advance ram being braced, by way of the cross member 21, against the roof support unit 1 which is clamped between the roof and the floor. In order to advance the roof support unit 1 in a follow-up advance step, the advance ram 11 is extended, so that its outwardly-moving piston rod 19 advances the roof support unit 1 (which is no longer braced between the roof and the floor) towards the conveyor 16 by means of the cross member 21. If, during the advance of the roof support unit 1, the front ends of the floor girders 2 and 3 strike a step in the floor or, under the load of the roof, have become pressed into the soft floor, then with the help of lifting means described below, the front ends of the girders 2 and 3 can be lifted to such an extent that they can override the obstacle.

The lifting means comprises a separate lifting mechanism associated with each of the floor girders 2 and 3. Each lifting mechanism has a hydraulic lifting ram 24 mounted on the associated floor girder 2 or 3. The two lifting rams 24 are positioned to the rear of the cross member 21, and adjacent to the opposite sides of the piston rod 19 of the advance ram 11. The piston rod 19 has a length that is greater than the working stroke of the advance ram 11. Consequently, the free end of the piston rod 19 projects from the advance ram 11 by a predetermined amount when the piston rod is completely retracted. This enables the two lifting rams 24 to lie closely alongside the piston rod 19.

Figure 4:
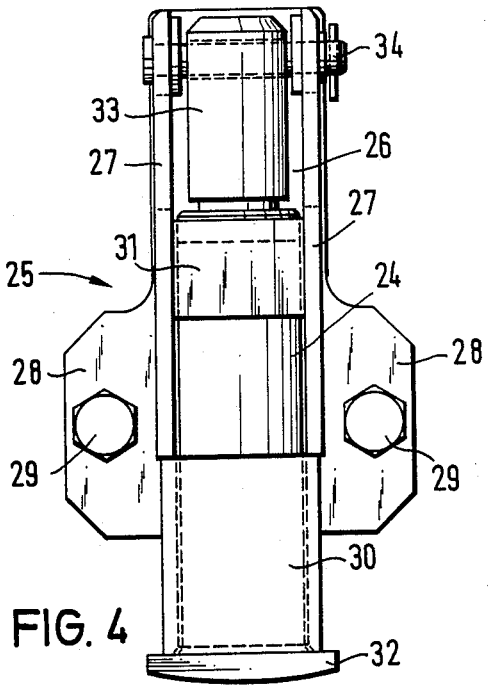
FIG. 4 is an enlarged front elevation of part of one of the lifting mechanisms shown in FIGS. 1 to 3.
Figure 5:
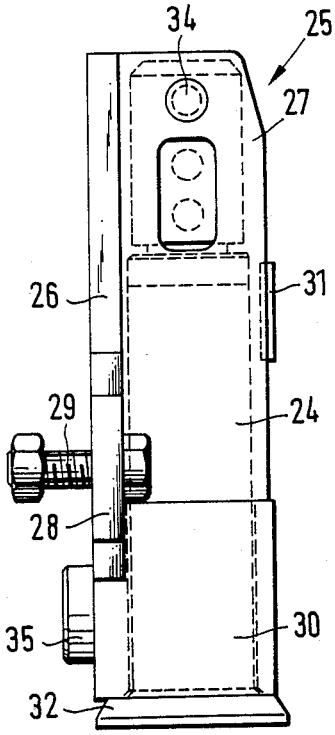
FIG. 5 is a side elevation of the mechanism shown in FIG. 4.

The lifting rams 24 are each mounted in a cylinder holder 25 (see FIGS. 4 and 5). Each cylinder holder 25 is constituted by a rear plate 26 and two side plates 27. The side plates 27 are secured to the two vertical side edges of the rear plate 26, the side plates being disposed at right-angles to the rear plate so that a U-shaped structure is formed. At each of its sides, each rear plate 26 has mounting flanges 28, which project beyond the associated side plates 27 and contain holes for bolts 29. In the lower zone, a bottom sleeve 30 (which accommodates the base of the associated lifting ram 24) is solidly connected to each rear plate 26. At a predetermined distance above the bottom sleeve 30 of each holder 25, the side plates 27 are interconnected by a transverse, reinforcing plate 31. Each lifting ram 24 has a slide member 32 at its base. Each of the rams 24 can be introduced, from below, into its cylinder holder 25, and then the head 33 of its piston rod can be connected, by means of a transverse pin 34, to the upper end of the cylinder holder. Each transverse pin 34 passes through aligned holes formed in the associated side plates 27 and the head 33 of the associated piston rod. As shown in FIG. 4, each slide member 32 is convexly curved in the advance direction.

During assembly, the two cylinder holders 25 (together with the fitted lifting rams 24) are introduced into the space between the floor girders 2 and 3, and are secured to the cheek plates 22, which are rearwardly extended for this purpose. As shown in FIG. 5, a high-strength stud 35 is secured to each rear plate 26 near its lower end. During assembly, the rear plate 26 of each cylinder holder 25 is laid against the associated cheek plate 22, so that its stud 35 engages in a complementary opening in that cheek plate. Then, as shown best in FIGS. 2 and 3, the cylinder holders 25 are secured to the cheek plates 22 by the bolts 29, which extend through the aligned holes in the mounting flanges 28 and in the cheek plates.

Figure 2:
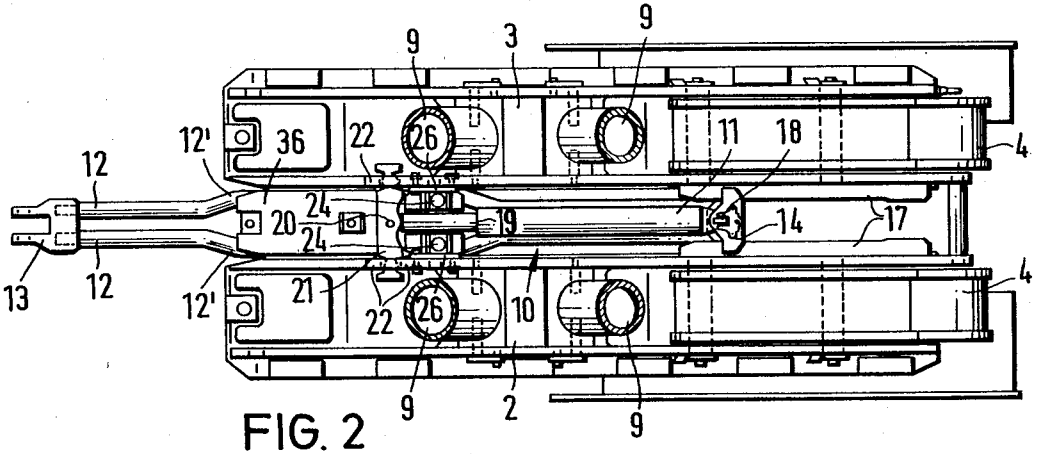
FIG. 2 is a horizontal section through the roof support unit of FIG. 1, and shows, in plan, the floor girders, the advance mechanism and the lifting mechanisms of the roof support unit.
Figure 3:
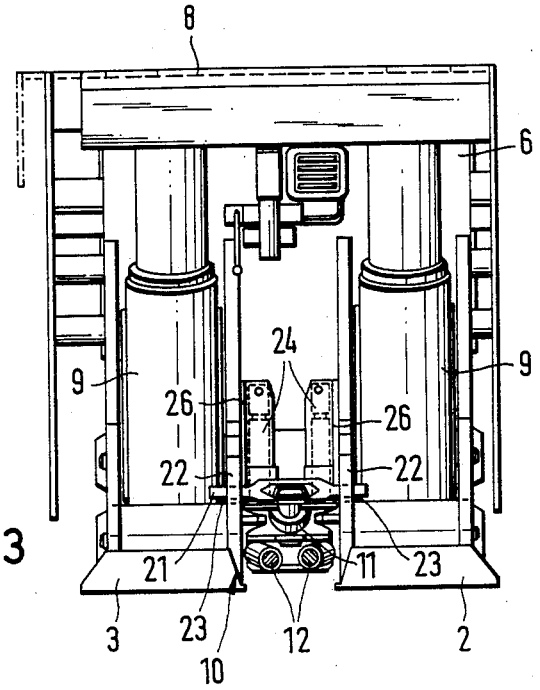
FIG. 3 is an end elevation, as seen from the face to be won, of the roof support unit of FIG. 1.

A slide plate 36, for jointly bracing the two lifting rams 24, is arranged in the space between the two floor girders 2 and 3. As shown in FIG. 2, the slide plate 36 is secured to the two guide rods 12. In the zone between their ends, the guide rods 12 are outwardly cranked relatively to each other, at 12', over the length which is greater than the working stroke of the advance ram 11. The slide plate 36 is secured to these cranked portions 12' of the guide rods 12.

Figure 7:
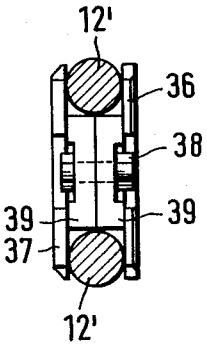
FIG. 7 is a transverse cross-section of the arrangement shown in FIG. 6.
Figure 6:
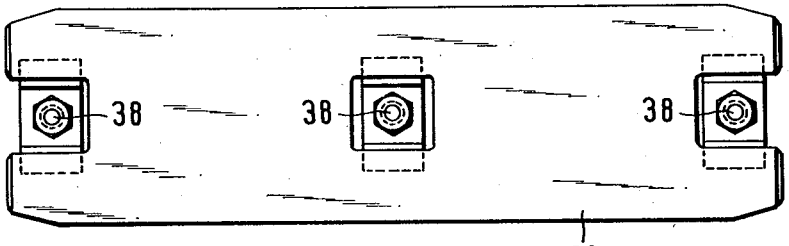
FIG. 6 is a plan view of a slide plate arrangement which is used with the lifting mechanisms of the roof support unit shown in FIGS. 1 to 5.

As shown in FIGS. 6 and 7, the portions 12' of the guide rods 12 are firmly gripped between the overlying slide plate 36 and an underlying complementary plate 37 which are clamped together by bolts 38. The ends of the bolts (and the associated nuts) are sunk into recesses in the two plates 36 and 37. At their mutually-facing sides, and in the zones of the bolt-fixing points, the plates 36 and 37 are provided with distance pieces 39 which space the plates relatively to each other.

When the lifting rams 24 are pressurised, the slide members 32 move out downwardly into abutment with the slide plate 36. Therefore, when the rams 24 are further extended, the tips of the floor girders 2 and 3 are raised from the floor. Since the two lifting rams 24 can be hydraulically actuated either separately or in unison, it is possible to raise the floor girders 2 and 3 either separately or jointly. When the roof support unit 1 is advanced, the lifting rams 24 slide away forwardly over the slide plate 36 on their slide members 32.

Figure 8:
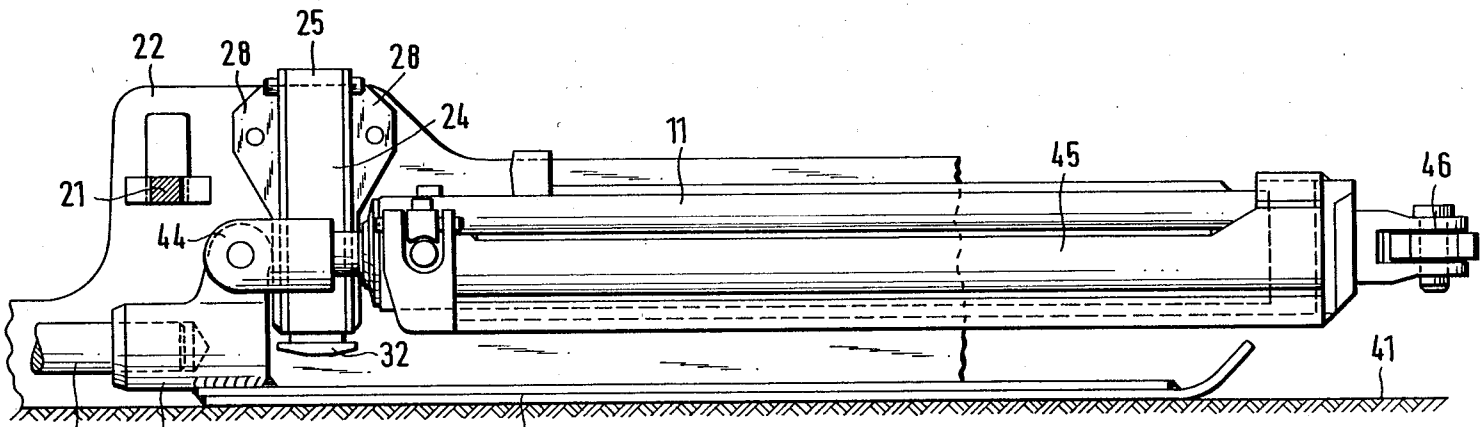
FIG. 8 is a side elevation showing a modified form of construction in accordance with the invention.

Whereas the form of construction shown in FIGS. 1 to 7 provides for the bracing of the lifting rams 24 against the girder rod system formed by the guide rods 12, FIG. 8 illustrates a modified construction in which the lifting rams 24 are displaceably supported, by their slide members 32, on a plate 40 which rests on the floor 41. The floor plate 40 underlies the advance ram 11, and its forward end is secured to a slide member 42. The rear end of the guide rod system 43 is also connected to the slide member 42. The front (face-side) end of the guide rod system 43 (which like that of FIGS. 1 to 7 is constituted by a pair of parallel, cylindrical, laterally-spaced, resilient rods) is connected to the longwall conveyor 16. The head 44 of the piston rod of the advance ram 11 is pivotally connected to the slide member 42. The advance ram 11 lies in a dished container 45, and is connected thereto at its front (face-side) end. The advance ram 11 is connected, by a pivot joint 46, at its rear (goaf-side) end to the floor girders (not shown). As with the embodiment of FIGS. 1 to 5, the front zones of the floor girders are provided with upstanding cheek plates 22, by means of which they are interconnected by means of a cross member 21 in such a manner that they can move vertically relative to each other. Similarly, the lifting rams 24 have holders 25 whose rear plates 26 have mounting flanges 28, by means of which the holders are bolted to the cheek plates 22. Here again, the lifting mechanisms lie at the goaf side to the rear of the cross member 21, and closely alongside the piston rod of the advance ram 11. In the FIG. 8 arrangement, the guide rod system 43 can be used only for transmitting the thrust force of the advance ram 11 to the conveyor, but cannot serve simultaneously for guiding the floor girders.

It will be understood that the floor plate 44 of the FIG. 8 embodiment could be used in place of the plates 36 and 37 in the roof support unit of FIGS. 1 to 7.

It will be apparent that modifications to the preferred forms of construction described above are possible. For example, instead of arranging the lifting mechanisms on the goaf side of the cross member, it would be possible to arrange the lifting mechanisms on the face side of the cross member.

I claim:

1. A mine roof support unit including a pair of generally parallel floor girders, and an advance mechanism positioned between the floor girders, the advance mechanism comprising a hydraulic advance ram and a guide rod system, the advance ram being pivotally connected between the guide rod system and a cross member, the guide rod system being attached to an abutment means positioned adjacent to a work face, means for engaging the cross member with the floor girders in a manner permitting the floor girders to be relatively displaceable in a vertical direction, wherein each of the floor girders is provided with a repsective lifting mechanism, the arrangement being such that the lifting mechanisms can be operated to lift one of the floor girders relative to the other floor girder.

2. A roof support unit according to claim 1, wherein each lifting mechanism includes a hydraulic lifting ram mounted on the associated floor girder.

3. A roof support unit according to claim 2, wherein the lifting rams are positioned on the goaf side of the cross member.

4. A roof support unit according to claim 3, wherein the piston rod of the advance ram is connected to the cross member.

5. A roof support unit according to claim 4, wherein the lifting rams are arranged one at each side of the piston rod of the advance ram.

6. A roof support unit according to claim 1, further comprising a slide plate positioned between the two floor girders, the slide plate forming an abutment for the two lifting rams.

7. A roof support unit according to claim 6, wherein the slide plate is rigidly connected to the guide rod system.

8. A roof support unit according to claim 6, wherein the slide plate is a floor plate which rests on the floor of the working.

9. A roof support unit according to claim 7, wherein the guide rod system is constituted by two laterally-spaced, cylindrical, resilient guide rods which are connected together at their front (face-side) ends by a head-piece, and whose rear (goaf-side) ends are guided on the floor girders for movement in the advance direction.

10. A roof support unit according to claim 9, wherein the two guide rods have laterally outwardly off-set portions, said off-set portions having a length which is greater than the length of the working stroke of the advance ram, and wherein the slide plate is fixed to said off-set portions of the guide rods.

11. A roof support unit according to claim 10, wherein the two guide rods are gripped between the slide plate and an underlying complementary plate, the two plates being provided with distance pieces which space them from each other, and the two plates being fixed together by screw-threaded members.

12. A roof support unit according to claim 2, wherein each of the floor girders is provided with an upstanding connection piece to which the associated lifting mechanism is mounted.

13. A roof support unit according to claim 12, wherein each of the connection pieces is a cheek plate, the cheek plates being provided with openings for receiving the cross member.

14. A roof support unit according to claim 12, wherein each of the lifting rams is housed in a holder, the holders being provided with mounting flanges for attachment, by means of bolts, to the connection pieces.

15. A roof support unit according to claim 14, wherein each of the holders includes a stud which engages in an aperture formed in the associated connection piece.

16. A roof support unit according to claim 14, wherein each of the holders comprises a rear plate and two side plates rigidly connected thereto, the rear plate defining said mounting flanges, and the two sides plates defining a connection point for the piston rod of the associated lifting ram, the rear and side plates of each holder acccommodating the associated lift ram.

17. A roof support unit according to claim 16, wherein each holder further comprises a bottom sleeve which encloses the lower end of the associated lifting ram, and which is rigidly fixed to the respective rear plate.

18. A mine roof support unit including a pair of generally parallel floor girders, and an advance mechanism positioned between the floor girders, the advance mechanism comprising a hydraulic advance ram and a guide rod system, the advance ram having a cylinder pivotally connected to the guide rod system and a piston pivotally connected to a cross member, the guide rod system being attached to an abutment means positioned adjacent to a work face, means for engaging the cross member with the floor girders in a manner permitting the floor girders to be relatively displaceable in a vertical direction, wherein each of the floor girders is provided with a respective lifting mechanism, said lifting mechanisms being located on opposite sides of the piston rod and on the goaf side of said cross member, and a slide plate positioned between the two floor girders to provide an abutment for the lifting mechanisms, the arrangement being such that the lifting mechanisms can be operated in engagement with the slide plate to lift one of the floor girders relative to the other floor girder.

* * * * *